US008051536B2

(12) United States Patent
Konecek-Hughes

(10) Patent No.: US 8,051,536 B2
(45) Date of Patent: Nov. 8, 2011

(54) MAGNETIC DRAPERY TRACK

(76) Inventor: Kathleen M. Konecek-Hughes, Clearwater, FL (US)

( * ) Notice: Subject to any disclaimer, the term of this patent is extended or adjusted under 35 U.S.C. 154(b) by 409 days.

(21) Appl. No.: 12/080,610

(22) Filed: Apr. 4, 2008

(65) Prior Publication Data

US 2008/0250608 A1 Oct. 16, 2008

Related U.S. Application Data

(60) Provisional application No. 60/923,654, filed on Apr. 16, 2007.

(51) Int. Cl.
*E06B 3/46* (2006.01)

(52) U.S. Cl. ..... 16/96 R; 16/87.4; 16/94 R; 16/94 D; 16/95 R; 16/96 D; 49/409; 52/DIG. 4

(58) Field of Classification Search ..... 16/87.4, 16/94 R, 94 D, 95 R, 96 R, 96 D; 248/265, 248/269; 211/94.01, 162, DIG. 1; 49/409; 160/DIG. 16; 52/DIG. 4
See application file for complete search history.

(56) References Cited

U.S. PATENT DOCUMENTS

| | | | | | |
|---|---|---|---|---|---|
| 361,248 | A | * | 4/1887 | Winton | 335/285 |
| 1,932,143 | A | * | 10/1933 | Piercy | 362/398 |
| 2,343,813 | A | * | 3/1944 | Simon | 160/90 |
| 2,580,099 | A | * | 12/1951 | Jaeger | 335/285 |
| 3,155,149 | A | * | 11/1964 | Ford | 160/346 |
| 3,188,699 | A | * | 6/1965 | Walters | 49/152 |
| 3,273,197 | A | * | 9/1966 | Ford | 16/94 D |
| 3,346,993 | A | * | 10/1967 | Johnson | 49/409 |
| 3,358,319 | A | * | 12/1967 | Hillenbrand et al. | 16/87.4 R |
| 3,374,823 | A | * | 3/1968 | Ford | 160/331 |
| 3,871,082 | A | | 3/1975 | Pflum | |
| 3,975,792 | A | * | 8/1976 | Janson | 16/87.4 R |
| 4,023,609 | A | | 5/1977 | Rosenquist | |
| 4,090,265 | A | * | 5/1978 | Baus | 4/607 |
| 4,120,474 | A | | 10/1978 | Hurley | |
| 4,821,370 | A | | 4/1989 | Magdars | |
| 5,240,213 | A | * | 8/1993 | Horcher | 248/223.41 |
| 5,544,747 | A | * | 8/1996 | Horn | 206/378 |
| D379,920 | S | | 6/1997 | Bozzo | |

(Continued)

OTHER PUBLICATIONS http://www.dwconline.com Click: Articles ( bottom of web page) Records #2521 to 2556 Apr. 1996 "Tools of the Trade" by: Cheryl Strickland.

(Continued)

*Primary Examiner* — Victor Batson
*Assistant Examiner* — Roberta Delisle
(74) *Attorney, Agent, or Firm* — Ronald E. Smith; Smith & Hopen, P.A.

(57) ABSTRACT

A drapery holder releasably engages a header jamb of a window. A vertical front wall and back wall are disposed in parallel relation to one another and are interconnected to one another by a horizontal bottom wall. Co-planar horizontal flanges are formed integrally with the front wall and the back wall and extend toward one another. Respective inboard ends of the horizontal flanges are spaced apart from one another to capture drapery carriers that are slideable along the extent of the horizontal flanges under the control of a drapery control apparatus. A channel is formed by the horizontal bottom wall and respective upper ends of the front and back walls and a plurality of magnets is positioned within the channel. Each magnet magnetically engages ferrous materials that form a part of the header jamb so that the drapery holder is releasably secured to the header jamb by a magnetic field.

9 Claims, 1 Drawing Sheet

U.S. PATENT DOCUMENTS

| | | | | |
|---|---|---|---|---|
| 5,746,329 | A * | 5/1998 | Rondeau | 211/123 |
| 5,967,217 | A * | 10/1999 | Wu | 160/331 |
| 6,257,307 | B1 * | 7/2001 | Tollivar | 160/368.1 |
| 6,532,625 | B1 | 3/2003 | Stone | |
| 6,748,943 | B1 * | 6/2004 | Krimmer | 126/547 |

OTHER PUBLICATIONS

The American Institute of Architects Ramsey/Sleeper "Architectural Graphic Standards" Seventh Edition Copyright 1981 by: John Wiley & Sons, Inc. Printed in USA Framing Details for Openings p. 321—Window Opening Gypsum Wallboard and Accessories p. 468—Metal thin-coat bead referred in the industry as corner bead. Installation Details for Metal Windows p. 446.

www.alumaxbath.com Click: Sliding Shower Doors (bottom of web page) Click: 340 & 350 Series Frameless Slider Bath Enclosures pp. 1-8.

http://www.dwconline.com Click: "How to Install a Shower Door" by: Joseph Truini & contractor Rich Rosenfield.

www.finehomebuilding.com Click: Magazine Index Search: Steam Showers by: Andy Engel Issue:143 Kitchen & Baths 2001 p. 86.

* cited by examiner

MAGNETIC DRAPERY TRACK

CROSS-REFERENCE TO RELATED APPLICATIONS

This application is a continuation of and claims priority to Provisional Application No. 60/923,654 filed Apr. 16, 2007 by the same inventor, entitled "Magnetic Drapery Track Without Mounting Hardware." That application is hereby incorporated into this application by reference.

BACKGROUND OF THE INVENTION

1. Field of the Invention

This invention relates, generally, to window or door coverings. More particularly, it relates to window or door coverings that are installed without the use of conventional mounting members such as screws, clips, brackets and the like.

2. Description of the Prior Art

In the construction of openings including but not limited to windows and sliding doors and doorways it is desirable to provide coverings such as textiles to shield not only the elements but to provide privacy as well. Most conventional vertical blinds or draperies are suspended from some form of track. These tracks require direct mounting by screws, brackets, or clips. An inside mount overlies the head jamb which is the horizontal part of the opening and may be attached to said head jamb or the vertical side jambs, or to both the head and side jambs. An outside mount engages a wall at the level of the head jamb. No attachment means engages any of the jambs that frame the window opening.

Mounting hardware is often cumbersome to install because the hardware items are typically quite small and difficult to work with. Installing the mounting hardware often requires several hand tools as well as a ladder. The hardware if installed incorrectly damages the gypsum-based drywall, plasterboard, or other wall or window jamb covering.

Thus there is a need for a window covering that may be installed in the absence of conventional mounting hardware.

However, in view of the art considered as a whole at the time the present invention was made, it was not obvious to those of ordinary skill in the art how the needed structure could be provided.

SUMMARY OF THE INVENTION

The long-standing but heretofore unfulfilled need for window coverings that may be installed in the absence of mechanical fastening members such as screws, brackets, clips, anchors and the like is now met by a new, useful, and non-obvious invention.

The inventive structure is a drapery holder adapted to engage a header jamb of a window, door, or other opening in a building structure. The novel drapery holder includes a vertical front wall and a vertical back wall disposed in parallel relation to one another, a horizontal bottom wall disposed in interconnecting relation to the vertical front wall and the vertical back wall and having the same longitudinal extent as the vertical front and back walls. A horizontal flange is formed integrally with the front wall and a horizontal flange is formed integrally with the back wall. The flanges are coplanar and extend toward one another in an inboard direction relative to their respective vertical front and back walls.

The horizontal flanges extend the entire length of their associated vertical front and back walls and respective inboard ends of the horizontal flanges are spaced apart from one another by a predetermined distance.

A plurality of drapery carriers is slidingly captured between the horizontal flanges so that each drapery carrier of the plurality of drapery carriers is captured between the horizontal flanges and is adapted to slide to any preselected position along the extent of the horizontal flanges under the control of a suitable drapery control means.

A channel is formed by the horizontal bottom wall and respective upper ends of the vertical front and back walls and a plurality of magnets is positioned within the channel. Each magnet of the plurality of magnets is adapted to magnetically engage ferrous materials that form a part of the header jamb. The drapery holder is therefore releasably secured to the header jamb by a magnetic field formed by the magnets, the magnets having a collective strength sufficient to hold the drapery holder to the header jamb when a drapery is connected to the drapery carriers and when the drapery is opened and closed by suitable drapery opening and closing means. The collective strength of the magnets is insufficient to hold the drapery holder to the header jamb when the drapery holder is subjected to a downward pull that exceeds the collective strength. In a first embodiment, each of the magnets has a parallelepiped construction. In a second embodiment, each magnet has an "L"-shaped structure.

A first valence obscures the carrier members from view when the drapery holder is viewed from an interior of the building structure. The first valence is formed by the vertical front wall extending below the horizontal flange formed integrally with the vertical front wall. The valence also obscures from view, when the drapery holder is viewed from an interior of the building structure, a parting line where the drapery holder abuts the header jamb. The vertical front wall of the first valence extends above the parting line to obscure said parting line.

A second valence obscures the carrier members from view when the drapery holder is viewed from an exterior of the building structure. The second valence is formed by the vertical back wall extending below the horizontal flange formed integrally with the vertical back wall.

The drapery holder is preferably provided in the form of an elongated aluminum extrusion of preselected length. It may also be provided in the form of an extruded thermoplastic track of preselected length.

An important object of the invention s to provide a drapery holder that can be installed quickly and in the absence of tools, in the absence of brackets installed with tools, and in the absence of making holes or bores in walls or window jambs.

Another important object is to provide a drapery holder that stays in place during normal use but which safely releases from its mount if subjected to unusually heavy downward forces.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which:

FIG. 1 is a sectional perspective view depicting the novel magnetic drapery track magnetically secured to a head jamb of an opening formed in a structure; and.

DETAILED DESCRIPTION OF THE PREFERRED EMBODIMENT

Figure 1:
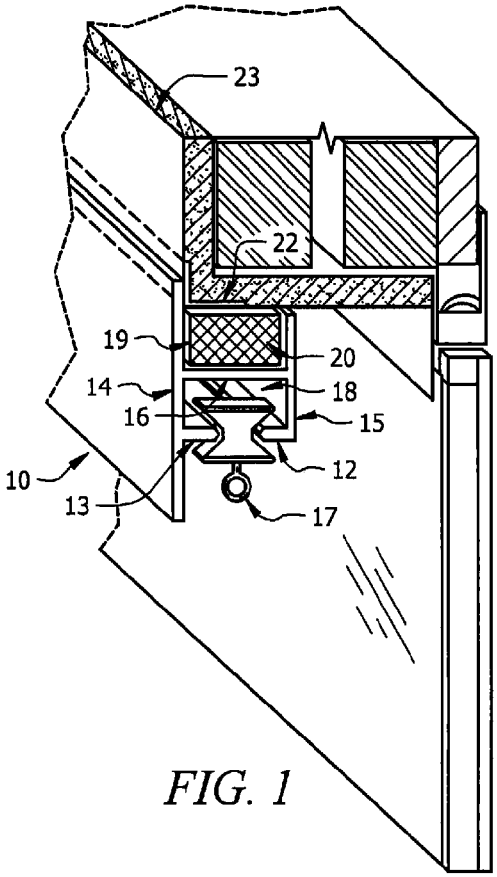

FIG. 1 depicts an illustrative embodiment of the novel structure which is denoted as a whole by the reference numeral 10.

Novel magnetic drapery track 10 includes vertical front wall 14 and vertical back wall 15. Said walls are parallel to one another and are interconnected to one another by horizontal bottom wall 16 that has the same longitudinal extent as said front and back walls.

Horizontal flange 13 is formed integrally with front wall 14 and horizontal flange 12 is formed integrally with back wall 15. Flanges 12 and 13 are co-planar and extend toward one another in an inboard direction relative to their respective front and back walls 14 and 15. Flanges 2 and 13 extend the entire length of their associated walls 14, 15. The respective inboard ends of flanges 12 and 13 are spaced apart from one another by a predetermined distance.

A plurality of drapery carriers is slidingly captured between flanges 12 and 13. Only one of said carriers, denoted 17, is depicted in FIG. 1. These carriers carry a drapery in a very well-known way so there is no need to depict a drapery being supported thereby, nor is there a need to depict the various well-known mechanisms that may be used to position the draperies in a fully closed position, a fully open position, or any position therebetween.

Each carrier 17 is captured between flanges 12 and 13 and is free to slide to any preselected position along the extent of said flanges under the control of a suitable drapery control means. The invention has utility in connection with drapery carriers of many different types and the scope of the invention is not limited to the particular drapery carrier depicted.

Each carrier 17 is adapted to receive supporting fasteners that are attached to the heading hem of a drapery panel which may be formed of fabric or other materials of differing weights.

Horizontal bottom wall 16 and the respective upper ends of vertical front and back walls 14, 15 collectively form upper channel 19. A plurality of magnets 20 are positioned within said upper channel 19, there being only one of such magnets depicted in FIG. 1. In this first embodiment, each magnet 20 has a parallelepiped structure. The strength of each magnet, the number of magnets, and the longitudinal spacing between the magnets, all depends upon the weight of the drapery to be supported as well as the space between the magnets and the ferrous material that overlies the heads jamb of the door, window, or other opening, the amount of ferrous materials, and so on.

Novel magnetic drapery track 10 is free of mounting hardware. It is preferably formed as an elongated aluminum extrusion or extruded thermoplastic track of any preselected length.

The drapery carrier members are of many types with the type denoted as 17 being illustrated for illustrative purposes only. Carrier members 17 slide within said track 10 along flanges 12, 13 to receive supporting fasteners, not depicted. The fasteners attach to the heading hem of a drapery panel in a well-known way. The draper panel can include fabrics or materials of different weights.

The ferrous material to which magnets 20 are attracted is a lath denoted 22. It is typically concealed from view and is commonly known as a corner bead or corner lath.

Ferrous lath 22 covers the bottom front edge of header jamb 23 which is formed of a nonferrous gypsum material 23 such as drywall, also known as sheetrock or plasterboard (gypsum-based wall coverings).

Some window, door, or other structural openings have exposed metal moldings and trim. Novel structure 10 is secured directly to such exposed metal openings and thus the strength of the magnetic fields is a little stronger than structures where the ferrous materials are thinly covered. The weight-responsive release of the magnets is thus slightly less sensitive in such installations but is still well within the requirements of safety.

In conventional construction, a valance is used to hide the sometimes unattractive carrier members 17 from view. Front wall 14 serves as a valence because it extends below flange 13 as depicted. This eliminates the need for a separate valance and additional hardware.

When drapery holder 10 is properly installed as depicted in FIG. 1, front wall 14 also extends above the plane that defines the bottom of the drywall header that forms the header jamb to cover the parting line created where novel drapery holder 10 abuts header jamb 23.

Although not depicted, back wall 15 may also extend below flange 12 to hide carrier members 17 when viewed from the exterior side of the window or door opening.

Figure 2:
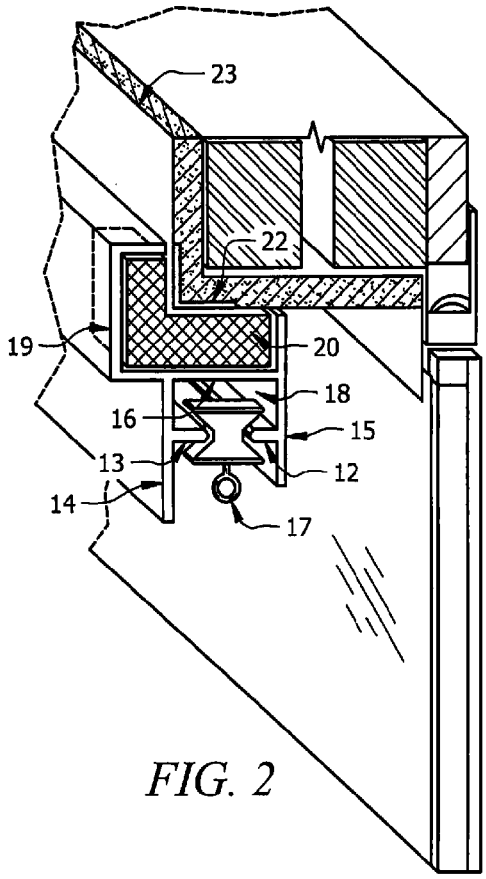
FIG. 2 is a view like that of FIG. 1 but depicting an alternate embodiment of the novel drapery track.

FIG. 2 depicts an alternative embodiment. Magnet 20 is "L"-shaped in this embodiment so that it wraps around the head jamb 23 which is typically formed of a gypsum product such as drywall, also known as sheetrock or plasterboard. The "L" shape increases the magnetic holding power of each magnet 20.

Magnets 20 at opposite ends of channel 19 may also be shaped to magnetically engage ferrous materials that underlie the vertical jambs as well for the same reason.

The combined strength of the magnets maintains the novel structure in abutting relation to header jamb 23 when a drapery is hung from carriers 17. However, said combined strength is insufficient to maintain the novel structure in abutting relation to said header jamb in the event a child or other individual becomes entangled in cords that control the opening and closing of the draperies, thereby preventing strangulation injuries.

If the ferrous materials are exposed, i.e., not covered by drywall, sheetrock, or the like, the inventive structure works in the same way, although the magnets will hold the novel structure to said exposed ferrous materials with increased strength. The increased strength is still inadequate to hold the novel structure in its operative position if an individual becomes entangled in said control cords.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

I claim:

1. A drapery holder adapted to engage a header jamb of a window, door, or other opening in a building structure, comprising:

said drapery holder including a vertical front wall and a vertical back wall disposed in parallel relation to one another;

a horizontal bottom wall disposed in interconnecting relation to said vertical front wall and said vertical back wall and having the same longitudinal extent as said vertical front and back walls;

a horizontal flange formed integrally with said front wall and a horizontal flange formed integrally with said back wall, said flanges being co-planar and extending toward one another in an inboard direction relative to their respective vertical front and back walls;

said horizontal flanges extending the entire length of their associated vertical front and back walls and respective inboard ends of said horizontal flanges being spaced apart from one another by a predetermined distance;

a plurality of drapery carriers slidingly captured between said horizontal flanges so that each drapery carrier of said plurality of drapery carriers is captured between said horizontal flanges and is adapted to slide to any preselected position along the extent of said horizontal flanges under the control of a suitable drapery control means;

a channel collectively formed by said horizontal bottom wall and respective upper ends of said vertical front and back walls;

a plurality of magnets positioned within said channel;

each magnet of said plurality of magnets adapted to magnetically engage ferrous materials that form a part of said header jamb;

whereby said drapery holder is releasably secured to said header jamb by a magnetic field collectively formed by said magnets;

whereby said magnets have a collective strength sufficient to hold said drapery holder to said header jamb when a drapery is connected to said drapery carriers and when said drapery is opened and closed by suitable drapery opening and closing means;

whereby said collective strength of said magnets is insufficient to hold said drapery holder to said header jamb when said drapery holder is subjected to a downward pull that exceeds said collective strength.

2. The drapery holder of claim 1, further comprising:

a valence for obscuring said carrier members from view when said drapery holder is viewed from an interior of said building structure;

said valence formed by said vertical front wall, said vertical front wall extending below the horizontal flange formed integrally with said vertical front wall.

3. The drapery holder of claim 1, further comprising:

a valence for obscuring said carrier members from view when said drapery holder is viewed from an exterior of said building structure;

said valence formed by said vertical back wall, said vertical back wall extending below the horizontal flange formed integrally with said vertical back wall.

4. The drapery holder of claim 1, further comprising:

a valence for obscuring from view, when said drapery holder is viewed from an interior of said building structure, a parting line where said drapery holder abuts said header jamb;

said vertical front wall of said valence extending above said parting line.

5. The drapery holder of claim 1, further comprising:

said drapery holder being provided in the form of an elongated aluminum extrusion of preselected length.

6. The drapery holder of claim 1, further comprising:

said drapery holder being provided in the form of an extruded thermoplastic track of preselected length.

7. The drapery holder of claim 1, further comprising:

each of said magnets having a parallelepiped construction.

8. The drapery holder of claim 1, further comprising:

each of said magnets having an "L"-shaped construction.

9. The drapery holder of claim 1, further comprising:

said magnets having a combined, collective strength sufficient to maintain said drapery holder in abutting relation to header jamb when a drapery is hung from said carriers;

said combined, collective strength being insufficient to maintain said drapery holder in abutting relation to said header jamb in the event a child or other individual becomes entangled in cords that control the opening and closing of the draperies, thereby preventing strangulation injuries.

* * * * *